United States Patent [19]

Wünsche

[11] Patent Number: 4,624,227

[45] Date of Patent: Nov. 25, 1986

[54] FOUR-STROKE INTERNAL COMBUSTION ENGINE WITH A LUBRICATING OIL PUMP

[75] Inventor: Peter Wünsche, Graz, Austria

[73] Assignee: AVL Gesellschaft für Verbrennungskraftmaschinen und Messtechnik m.b.H., Graz, Austria

[21] Appl. No.: 772,906

[22] Filed: Sep. 5, 1985

[30] Foreign Application Priority Data

Sep. 21, 1984 [AT] Austria ..... 3012/84

[51] Int. Cl.[4] ..... F02B 77/00

[52] U.S. Cl. ..... 123/198 C; 123/196 R; 123/195 C; 418/170; 184/6.28; 184/26

[58] Field of Search ..... 123/195 A, 196 R, 198 C; 184/6.28, 26; 418/169, 170

[56] References Cited

U.S. PATENT DOCUMENTS 4,518,332 5/1985 Saegusa ..... 418/171

FOREIGN PATENT DOCUMENTS 569285 1/1959 Canada ..... 418/170
1936837 1/1971 Fed. Rep. of Germany ..... 418/170
3022419 7/1971 Fed. Rep. of Germany .
2622145 6/1977 Fed. Rep. of Germany ..... 418/170
2631148 1/1978 Fed. Rep. of Germany ..... 418/170
3047609 9/1981 Fed. Rep. of Germany ..... 418/170
1027661 5/1953 France ..... 418/170
0153622 6/1973 German Democratic Rep. .

*Primary Examiner*—E. Rollins Cross
*Attorney, Agent, or Firm*—Watson, Cole, Grindle & Watson

[57] ABSTRACT

A lubricating oil pump for a four-stroke internal combustion engine includes a pump body; an annular gearwheel rotatably mounted around the outer perihery of the pump body, the annular gearwheel including projections on its outer surface to function as cams for valve control and including teeth on its inner surface; and a driving pinion mounted within the annular gearwheel and attachable to the crankshaft of the engine, the driving pinion including external teeth in meshing engagement with the internal teeth of the annular gearwheel such that the annular gearwheel rotates at half the speed of the driving pinion.

2 Claims, 2 Drawing Figures

FOUR-STROKE INTERNAL COMBUSTION ENGINE WITH A LUBRICATING OIL PUMP

BACKGROUND OF THE INVENTION

This invention relates to a four-stroke internal combustion engine with a lubricating oil pump comprising a housing with a pump body in which is rotating a driving pinion which is carried by the crankshaft and meshes with an annular gearwheel.

DESCRIPTION OF THE PRIOR ART

German laid-open print No. 30 22 419 describes an internal combustion engine of the above design whose lubricating oil pump is mounted on the crankshaft. The oil pump is provided with a housing comprising an outer part of a U-shaped cross-section which is firmly bolted to the crankshaft housing and also serves as the front end of the housing, and a pump body inserted into this outer part. The pump body is screwed to the outer part and has a cylindrical recess for holding an annular gearwheel. This annular gearwheel is eccentric relative to the crankshaft.

A gearwheel with external toothing is rigidly attached to the crankshaft, simultaneously meshing with the annular gearwheel. Due to the eccentric position of the two toothed wheels relative to each other a crescent-shaped chamber is formed into which is extending a crescent formed by the pump body. In addition, one step of the free end of the crankshaft carries a gearwheel which is used for driving a camshaft. Thus a number of components are necessary for the purpose of holding, lubricating and driving the camshaft in this known type of design.

SUMMARY OF THE INVENTION

It is an object of the present invention to avoid the above drawbacks of the known type of combustion engine while retaining its advantages. Above all, the engine is to be configured such as to simplify the design for driving, bearing and lubrication of the camshaft.

According to the invention this is achieved by using the outer circumference of the body of the lubricating oil pump as a bearing surface for the annular gearwheel and by providing valve-control cams on the circumference of the annular gearwheel rotating at half the speed of the crankshaft.

By supporting the annular gearwheel as proposed by the invention, i.e., on the outer circumference of the body of the lubricating oil pump, it is possible to place the valve-control cams on the outer circumference of the annular gearwheel rotating at half the speed of the crankshaft—the manner of positioning cams on the circumference of an annular gearwheel having been described before, in DD-PS No. 153 622, within the context of a cam-control mechanism for four-stroke engines. In this instance the cam rings have an internal toothing and are driven by a pinion-geared drive shaft at a gear reduction ratio of 2:1.

According to the invention the annular gearwheel which is part of the oil pump design functions as a conventional camshaft, thus rendering superfluous any components which would be required for driving, bearing and lubricating purposes in a conventional camshaft design. Besides, the present design will permit a compact assembly, which is of advantage for both cooling and the outer dimensions of the internal combustion engine, as it will help to save space and achieve suitable fitting dimensions. At the same time sufficient lubrication of the bearings is ensured by the leakage oil from the pump.

In another variant the gearwheel located on the crankshaft and the annular gearwheel together with a baseplate and a pump body attached thereto constitute the lubricating oil pump as pre-assembled unit. In this way the oil pump bearing valve-control cams on its circumference may be fully assembled before mounting it on the crankshaft as a unit, thus reducing assembly time of the engine.

The channels in the baseplate departing from the inlet or pressure chamber connect the lubricating oil pump to the oil filter and the oil circulation system of the combustion engine in a simple manner. This will permit the use of short and direct pipes for the oil circulation system. Baseplate and crankshaft housing may also be designed in one piece.

Basically, the invention can be applied for both single-cylinder and multi-cylinder combustion engines, in the latter instance above all for two-cylinder V-type engines and flat twin engines.

DESCRIPTION OF THE DRAWING

Following is a more detailed description of the invention as illustrated by the attached drawing in which.

DETAILED DESCRIPTION OF THE PREFERRED EMBODIMENT

Figure 1:
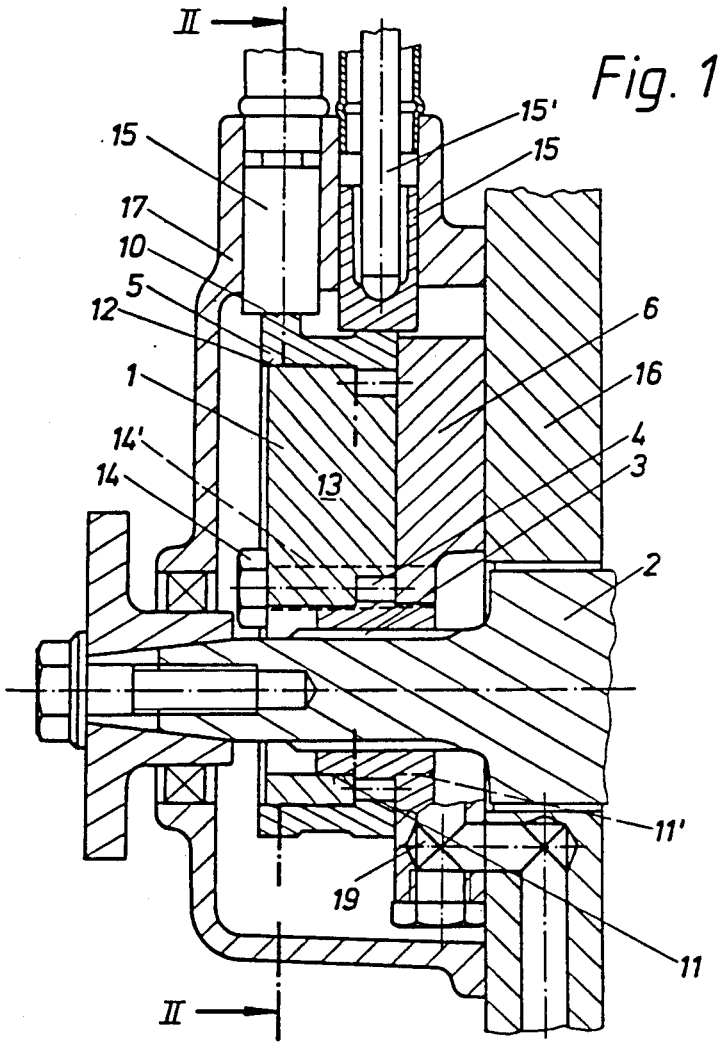
FIG. 1 shows part of an internal combustion engine as described by the invention, in a vertical section along line I—I in FIG. 2.
Figure 2:
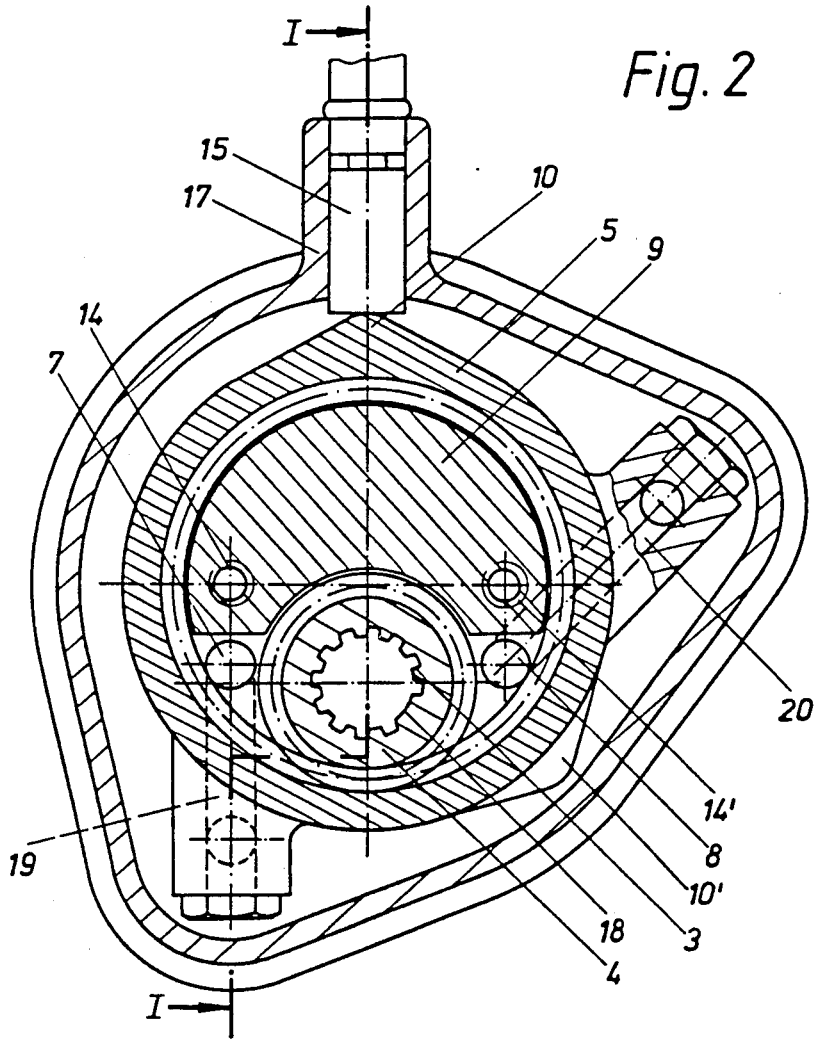
FIG. 2 shows a section along line II—II in FIG. 1.

The lubricating oil pump 13, which is mounted on a baseplate 6, is fastened to wall 16 of the crankshaft housing. Pump 13 is driven by the driving pinion 4 which is attached at the end of the crankshaft 2 by spline teeth 3 and serves as a pump gear. The driving pinion 4 is in mesh with the annular gearwheel 5 which has twice as many teeth and therefore operates at half the speed of the crankshaft. By means of the screws 14 passing through bores 14' the pump body 1 is mounted on the baseplate 6. The side of the pump body 1 next to the baseplate 6 is shaped like a crescent 9 and divides the chamber formed by the two gearwheels 4,5 into the inlet chamber 7 and the pressure chamber 8 of the gear pump. The circumference surface 12 of the pump body 1 which, viewed in the direction towards baseplate 6, is circular, acts as a bearing surface for the annular gearwheel 5. Bores 11 in the pump body 1 and 11' in the baseplate 6 which are eccentric relative to face 12, serve as bearing surfaces for the driving pinion 4. On the outer circumference of the annular gearwheel 5 there are located cams 10 and 10' which are staggered along the circumference, and which actuate the valves (not shown) of the internal combustion engine by means of valve tappets 15 and pushrods 15' passing through the housing 17.

The lubricating oil is fed into the inlet chamber 7 and carried off from the pressure chamber 8 via channels 19 and 20, respectively, in the baseplate 6 which are connected with the oil circulation system not shown in this drawing.

The lubricating oil pump 13 which comprises a baseplate 6, pump body 1, driving pinion 4 and annular gearwheel 5 including cams 10, 10', is configured as a pre-assembled unit.

The relative angle between the annular gearwheel 5 including cams 10, 10' and the crankshaft 2 is fixed by omitting a tooth 18 from the spline teeth 3.

I claim:

1. In a four-stroke internal combustion engine which includes a crankshaft and lubricating oil pump, the improvement wherein said lubricating oil pump comprises a housing defining a pump body which has an outer periphery which conforms to an arc of a circle; an annular gearwheel rotatably mounted around said pump body, said annular gearwheel having an inner surface which includes gear teeth extending radially inwardly thereof and an outer surface which includes projections thereon, said projections functioning as valve control cams; and a driving pinion positioned within said annular gearwheel and between said pump body and said annular gearwheel, said driving pinion being connectable to the crankshaft of said engine and including external teeth thereon which mesh with the radially-inwardly extending teeth of said annular gearwheel; the driving pinion having half as many teeth as said annular gearwheel such that said annular gearwheel will rotate at half the speed of said driving pinion.

2. The four-stroke internal combustion engine as defined in claim 1, wherein said pump body is generally crescent-shaped.

* * * * *

UNITED STATES PATENT AND TRADEMARK OFFICE

CERTIFICATE OF CORRECTION

PATENT NO. : 4,624,227

DATED : November 25, 1986

INVENTOR(S) : Peter Wünsche

It is certified that error appears in the above-identified patent and that said Letters Patent is hereby corrected as shown below:

[73] Assignee: AVL Gesellschaft für Verbrennungskraftmaschinen und Messtechnik mbH. Prof.Dr.Dr.h.c. Hans List.

Signed and Sealed this

Third Day of February, 1987

*Attest:*

DONALD J. QUIGG

*Attesting Officer*

*Commissioner of Patents and Trademarks*